US006776639B1

(12) United States Patent
Dennis et al.

(10) Patent No.: US 6,776,639 B1
(45) Date of Patent: Aug. 17, 2004

(54) LOAD-BEARING COUPLING FOR ELECTRICAL CORD

(76) Inventors: Charles Dennis, 607 Francis Ct., League City, TX (US) 77573; Rainer Kuenzel, P.O. Box 824, Hunt, TX (US) 78024

( * ) Notice: Subject to any disclaimer, the term of this patent is extended or adjusted under 35 U.S.C. 154(b) by 14 days.

(21) Appl. No.: 10/295,435

(22) Filed: Nov. 15, 2002

(51) Int. Cl.[7] ..... H01R 13/62; H01R 13/213
(52) U.S. Cl. ..... 439/314; 439/369
(58) Field of Search ..... 439/314, 312, 439/369, 367, 372

(56) References Cited

U.S. PATENT DOCUMENTS

| | | | | |
|---|---|---|---|---|
| 554,716 A | | 2/1896 | McEvoy | |
| 1,398,228 A | | 11/1921 | Grigsby | |
| 1,636,973 A | | 7/1927 | White | |
| 1,964,350 A | | 6/1934 | Greene | |
| 2,325,377 A | | 7/1943 | Dickie | |
| 2,366,910 A | | 1/1945 | Kollath | |
| 2,606,224 A | | 8/1952 | Modrey | |
| 2,626,299 A | * | 1/1953 | Richards | 439/314 |
| 2,825,039 A | | 2/1958 | Schurman et al. | |
| 3,217,282 A | | 11/1965 | Chevalier et al. | |
| 3,270,312 A | | 8/1966 | Olsen | |
| 3,786,397 A | | 1/1974 | Bridges | |
| 3,951,506 A | | 4/1976 | Bennett et al. | |
| 4,526,430 A | | 7/1985 | Williams | |
| 4,527,855 A | | 7/1985 | Dietrich | |
| 4,940,424 A | * | 7/1990 | Odbert | 439/369 |
| 5,505,634 A | | 4/1996 | Osten | |
| 5,616,046 A | | 4/1997 | Sundstrom et al. | |
| 5,649,835 A | | 7/1997 | Weed | |
| 5,662,488 A | * | 9/1997 | Alden | 439/314 |
| 6,069,841 A | | 5/2000 | Johnston | |
| 6,080,004 A | | 6/2000 | Kovacik et al. | |
| 6,135,803 A | | 10/2000 | Kovacik et al. | |
| 2002/0039853 A1 | * | 4/2002 | Weingartner | 439/314 |

* cited by examiner

*Primary Examiner*—Javaid H. Nasri
(74) *Attorney, Agent, or Firm*—Law Office of Tim Cook P.C.

(57) ABSTRACT

An electrical coupling comprises a sealing element, a mechanical securing element, and load bearing members on either side of the mechanical securing element. The load bearing members each comprise upper and lower body halves, which mount to an inner member through which an insulated electrical cable runs. Between the upper and lower body halves and the inner member, an open weave fabric is secured, and the fabric extends onto the electrical cable beyond the load bearing member, so that when stress is applied to the cable, the fabric tends to squeeze down onto the cable, thereby bearing the stress on the cable. The mechanical securing element is preferably a bayonet mount, including an O-ring seal providing a water resistant seal when the connection is made up.

15 Claims, 4 Drawing Sheets

LOAD-BEARING COUPLING FOR ELECTRICAL CORD

FIELD OF THE INVENTION

The present invention relates generally to the field of electrical cords for power tools, and, more particularly, to a water resistant, load-bearing coupling for a power tool.

BACKGROUND OF THE INVENTION

Electrical power tools are commonly provided with a male plug adapted to fit into a female receptacle of a power cord, particularly an extension power cord adapted to be plugged into a wall outlet or the like. Once made up, the connection provides electrical power to the power tool to run the tool. Users commonly use the power tool at some distance from the outlet, or even at some height above the outlet, so that the connection of the power cord to the tool, which typically relies primarily on friction to remain coupled, tends to come apart.

Electrical cord connections commonly in use today suffer from other drawbacks. Particularly, power tools using electrical extension cords are often used in environments in which the coupling of the cord is likely to come in contact with water or other liquids, or even be immersed in such a liquid. However, most electrical plugs which provide power to tools are not water proof or even water resistant. This problem with commonly used plugs may therefore present a safety hazard.

Commonly used cord connections also suffer from the drawback in that, even if such connections provide a means to keep the male end plugged into the female end, the means is seldom strong enough to keep the connection made up if the user drops the tool, or wishes to hoist the tool to the working location by the expedient of lifting the tool by the cord.

A number of connectors have been proposed to help to keep electrical plugs made up. For example, in U.S. Pat. No. 6,080,004, Kovacik et al. taught an electrical connection comprised of a pair of cooperating separable plug members having a separable locking yoke. The yoke defines legs, the ends of which are pivotally mounted to boss members formed on one of the plug members. The yoke further defines a pair of cooperating spaced apart elements for frictionally engaging the electrical conduit leading away from the other of the pug members. This plug lock helps to keep the plug members from coming apart, but the connection is not robust enough to permit substantial stress from being applied to the electrical cord. Further, the connection does not provide a water resistant seal.

Thus, there remains a need for an electrical cord connection that provides a positive means of maintaining an electrical connection, while sealing the connection in a manner that is resistant to the intrusion of water. The connection should be inexpensive and simple to manufacture and use, and should provide enhanced safety. The connection should also be robust enough to allow the user to lift a tool connected to an extension cord in a safe and expeditious manner. The present invention is directed to such an electrical connector.

SUMMARY OF THE INVENTION

The present invention addresses these and other needs in the art by providing an electrical coupling having a sealing element, a mechanical securing element, and load bearing members on either side of the mechanical securing element. The load bearing members each comprise upper and lower body halves, which mount to an inner member through which an insulated electrical cable runs. Between the upper and lower body halves and the inner member, an open weave fabric is secured, and the fabric extends onto the electrical cable beyond the load bearing member, so that when stress is applied to the cable, the fabric tends to squeeze down onto the cable, thereby bearing the stress on the cable.

Although other structures may be used within the spirit and scope of the invention, the mechanical securing element is preferably a bayonet mount. The bayonet mount is preferred principally because it provides a strong means of securing male and female ends together. The bayonet mount also provides the advantageous feature of sliding along axially, thereby permitting easy access to electrical component within the connector for repair and maintenance. The bayonet mount also includes an O-ring seal, making the connector water resistant when made up.

While the load bearing member has been described as adapted to take up the stress of an electrical cord in a connector, the load bearing member feature of the invention may also be applied to a hard wired connection to a hand tool, for example. The upper and lower members which retain the open weave fabric may be part of or attached to the butt end of a hand tool to absorb the strain of the cord to lessen the likelihood of pulling the cord out of the hand tool.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF A PREFERRED EMBODIMENT

Figure 1:
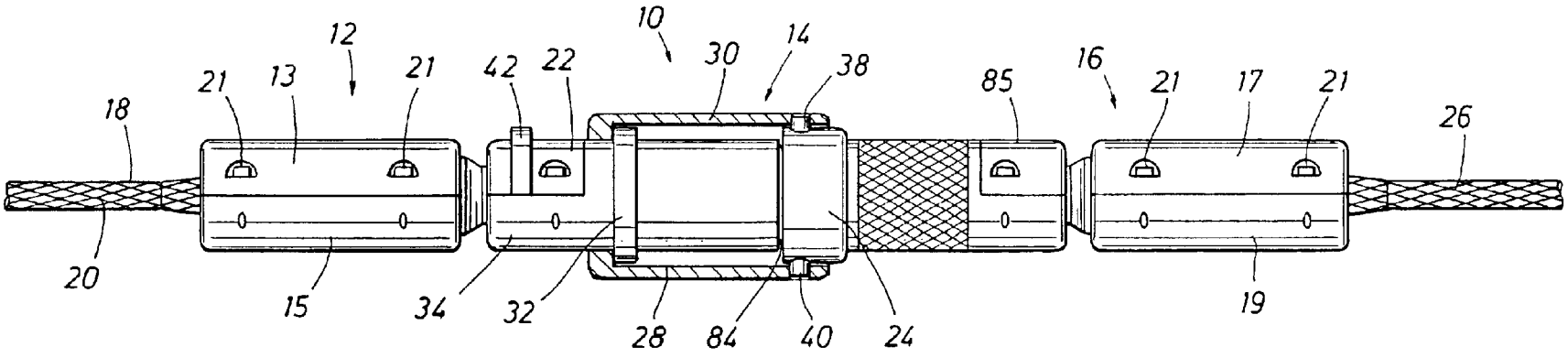
FIG. 1 is a side view in partial section of an electrical connector of the present invention.
Figure 2:
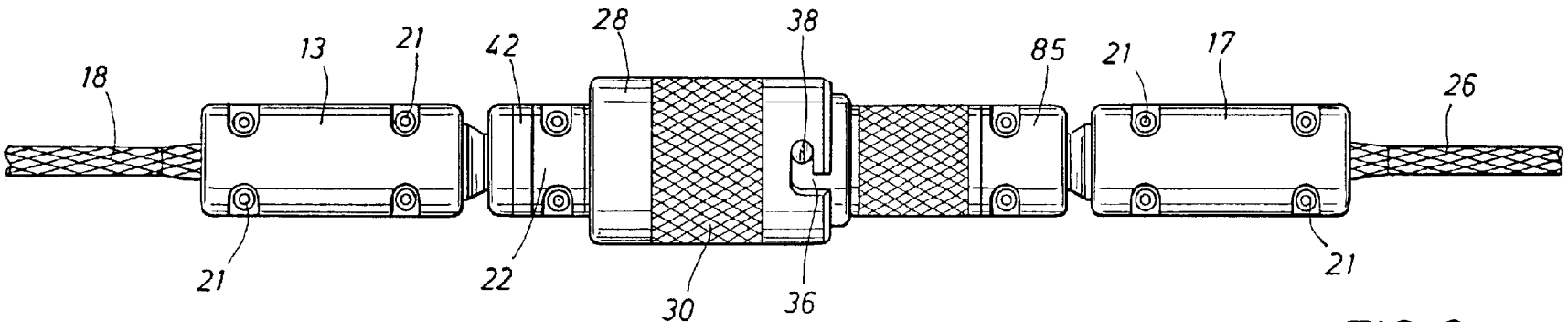
FIG. 2 is a top view of the connector illustrated in FIG. 1.

FIGS. 1 and 2 show the present invention comprising an electrical connector 10, having a left end load bearing member 12, a center coupling member 14, and a right end load bearing member 16. A power cord or connector supplying cable 18 extends from an electrical outlet (not shown) and is wrapped in an open weave outer lining or fabric 20, which serves to bear the load of the connector 10 and the tool (not shown) to which the connector 10 provides power. The power cord 18 extends into the left end load bearing member 12, shown and described below in greater detail in respect of FIGS. 3 through 5. The power cord 18 continues through the member 12 and into a center female section 22, shown and described below in greater detail in respect of FIGS. 6 through 8. Electrical power from the power cord 18 passes through the center female section to a center male section 24, shown and described below in greater detail in respect of FIGS. 9 through 11. This electrical power, coupled through the male section 24 is conducted by a supply power cord or tool supplying cable 26, which in part is supported by the right end load bearing member 16.

Thus, in its simplest detail, the present invention comprises the load bearing and coupling members coupled end to end to provide a robust construction capable of bearing the weight of the tool powered by the connector, as well as providing a water resistant seal for the connection, as described below.

FIGS. 1 and 2 provide details of another feature of the invention, including a sliding bayonet mount 28. The bayonet mount 28 comprises a cylindrical body 30 which mounts over an annular flange 32 for sliding engagement with a body cylinder 34. The body further includes a slot 36 for releasable engagement with a post 38 when the connector is made up. The body has another slot (not shown) for engagement with a post 40 directly opposite the post 38 for balanced and secure mounting of the connector. The cylindrical body 30 moves an axial direction until it abuts a flange stop 42. When the connector is made up, a radially inwardly extending flange 31, which extends inwardly from the cylindrical body 30, abuts the annular flange 32 to compress an O-ring seal 84 (FIG. 6) and to retain the connector in a secured condition.

Figure 3:
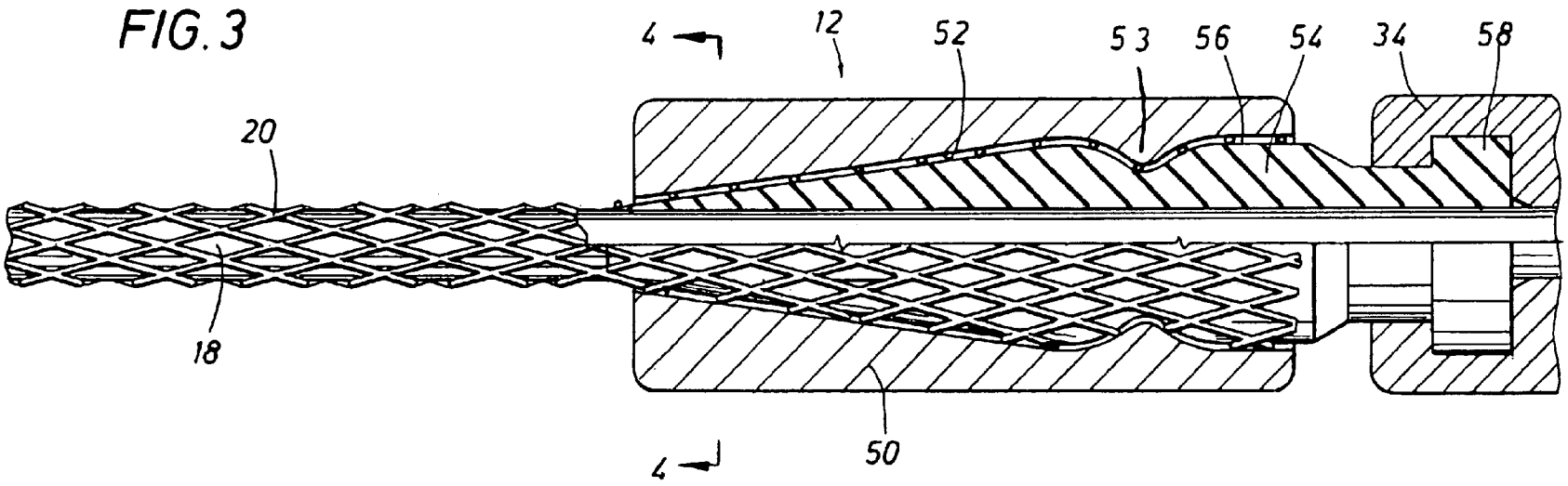
FIG. 3 is a detail section view is the left end of the connector, as viewed in FIG. 1.
Figure 4:
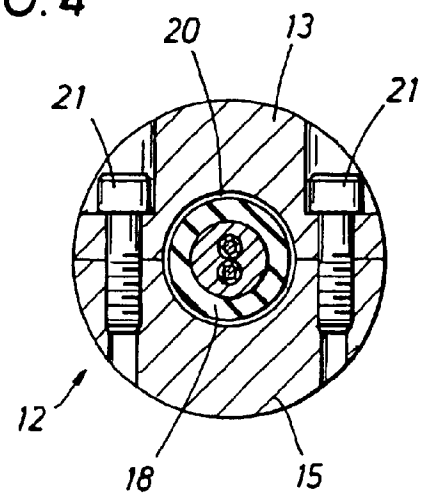
FIG. 4 is an end section view, as viewed along section lines 4—4 of FIG. 3.

FIGS. 3 and 4 depict the left end of the connector 10 of the invention including the load bearing member 12. The load bearing member 12 includes a body 50, preferably formed of separable halves 13 and 15 (FIG. 4). The body 50 is preferably formed of a hard, durable plastic. The body 50 describes an inner surface 52 having an hour-glass function defined by a pinched-in waist 53, although other shapes may be used within the scope and spirit of the invention, and this hour-glass function is considered a feature of the invention. Within the body 50 is an anchor member 54, which defines a surface 56 which is parallel to the surface 52, and thus also defining an hour-glass function. Between the surfaces 52 and 56 is the open-weave fabric 20 which, when force is applied to the cable 18, tends to stretch and squeeze down, thereby carrying the load of the force on the cable. The anchor body 54 also extends into the body 34 and terminates in a flange 58 which secures the body-54 to the body 34.

Therefore, the load bearing member 12 serves several functions. It prevents sharp bends in the cable near the coupling between the male and the female plugs; it absorbs forces applied to the cable in an axial direction, thereby preventing the electrical wiring from coming loose where it is wired into the connector; and it spreads the axial forces into a radial direction onto the cable.

FIG. 4 shows a cross sectional view taken through section lines 4—4 of FIG. 3. The upper half 13 of the load bearing member 12 is preferably bolted to the lower half 15 with the bolts 21. The cable 18 is secured between the body halves 13 and 15, with the open weave fabric 20 therebetween.

Figure 5:
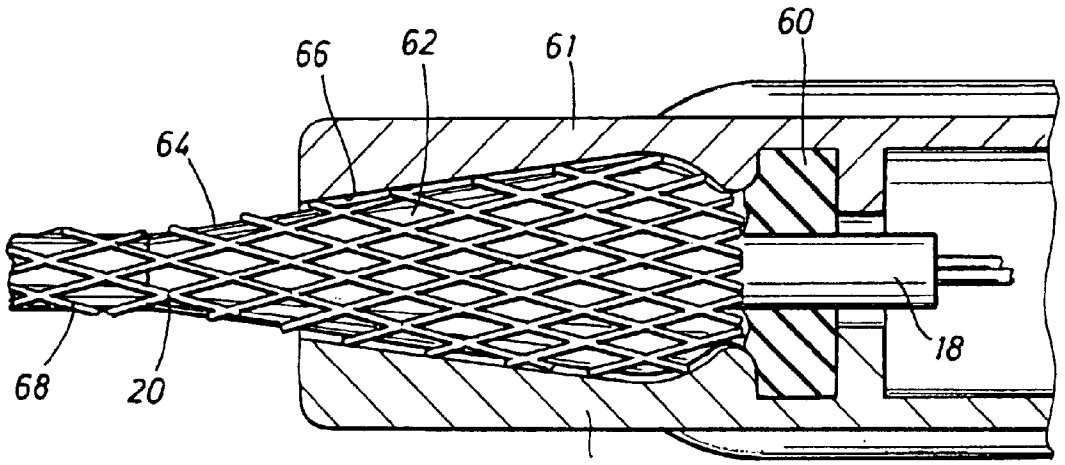
FIG. 5 is a further section view of the left end of the connector, illustrating an alternative embodiment of a stress bearing member of the connector.

FIG. 5 provides a view of an alternative embodiment of the invention, wherein the open-weave fabric 20 absorbs axial stress on a cable running into a power tool. In this embodiment, an upper tool half 61 and a lower tool half 63 extend outwardly to enclose a flange 60 and further to enclose an inner load bearing member 62. The inner load bearing member 62 defines an outer surface 64 which is parallel to an inner surface 66 of the load bearing member 62, enclosing therebetween an open weave fabric 68, which functions as previously described in respect of FIG. 3. In this way, as axial stress is applied to the power supplying cable, the stress is taken up by the open weave fabric compressed onto the load bearing member 62, and not on the cable 18.

Figure 6:
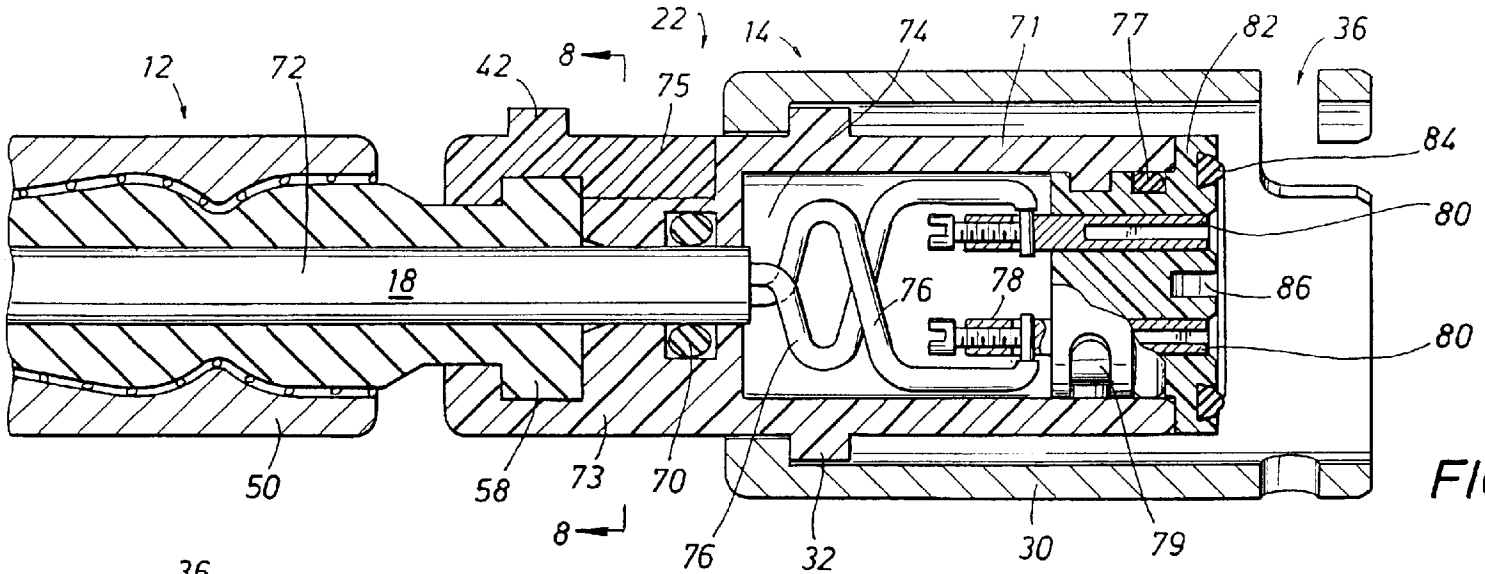
FIG. 6 is a detail section view of the center, female portion of the connector.
Figure 8:
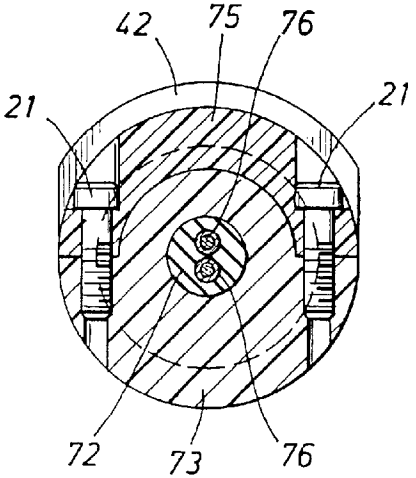
FIG. 8 is an end section view of the connector, as seen along section lines 8—8 of FIG. 6.
Figure 7:
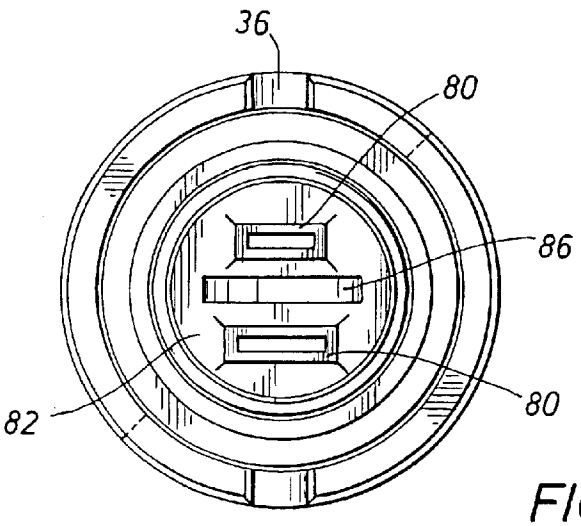
FIG. 7 is an end view of the female portion of the connector as seen from the right as viewed in FIG. 6.

FIGS. 6 through 8 illustrate a presently preferred embodiment of the center female section 22 of the invention, which is the female portion of the center coupling member 14. The load bearing member 12 mounts into the center coupling member 14 with a flange 58, as previously described. The cable 18 passes through the load bearing 20 member 12, and into the center female section 22, where it is sealed with an O-ring 70. The cable is covered with an outer insulation layer 72, which terminates as it enters a chamber 74 of the center female section. This structure is further illustrated in FIG. 8. Further, the chamber 74 is defined by a molded body 71. The molded body 71 extends axially toward the load bearing member 12 from the chamber 74, and also includes the annular flange 32. The molded body also includes a flange bearing section 73, which provides support for a saddle member 75, and the flange bearing section 73 and the saddle member 75 together retain the flange 58. The flange bearing section 73 and the saddle member 75 are preferably bolted together, as shown in FIG. 8.

From the point of termination of the insulation layer 72, individual insulated conductors 76 continue, where they are mounted to terminals 78. The terminals are electrically connected to female power slots 80, which are adapted to receive an industry standard male plug, shown below in respect of FIGS. 9 through 11. While the preferred embodiment is illustrated with a standard plug, the present invention is equally adapted to accommodate other types of plugs, including grounded, European standard, and other types. The female power slots 80 are embedded within an insulating block 82, which also mounts an O-ring seal 84. The O-ring seal 84 seals the electrical coupling between the female power slots 80 and the male plug, making the connection water resistant. When the bayonet connection is made up, the O-ring seal 84 is compressed, providing that seal. Also, the insulating block 82 is sealed against the body 71 with a gasket 77.

Formed within the insulating block 82 is a tool-receiving slot 86. The tool-receiving slot 86 enables the use of a flat head screwdriver, for example, for ease of mounting and disassembling the insulating block 82 for repair and replacement of components within the connector. The insulating block 82 engages a J-slot 79 to secure the insulating block within the body 71.

Figure 9:
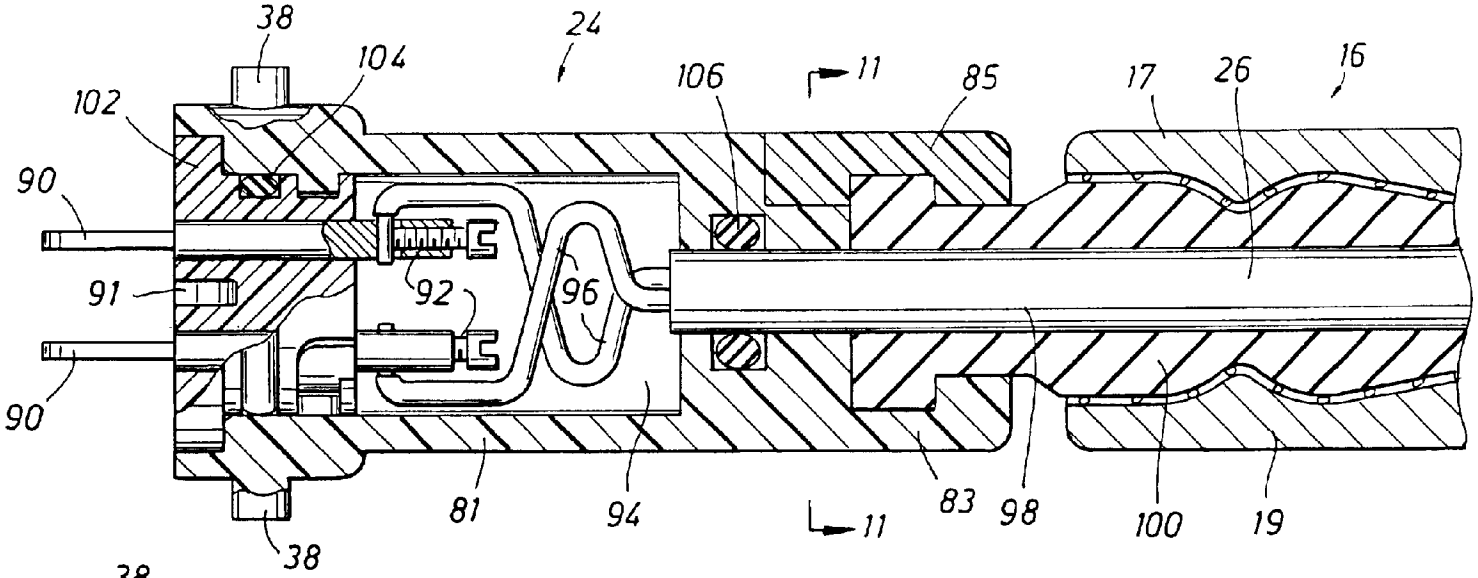
FIG. 9 is a section view of the center, male portion of the connector.
Figure 11:
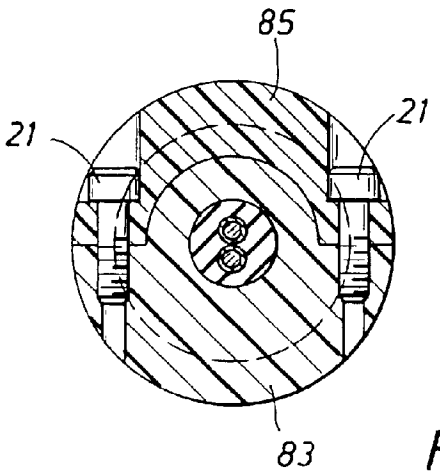
FIG. 11 is an end section view of the connector, as seen along section lines 11—11 of FIG. 9.
Figure 10:
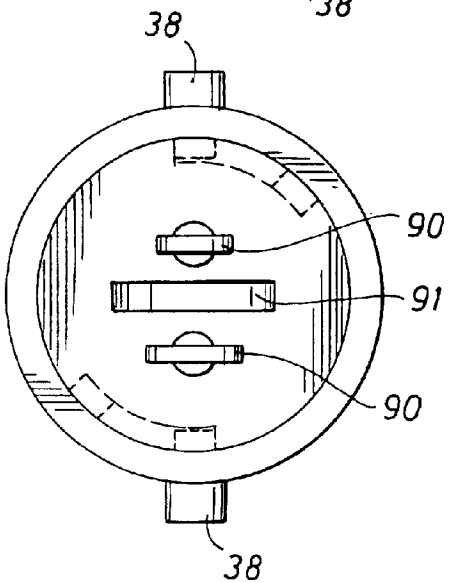
FIG. 10 is an end view of the male portion of the connector as seen from the left as viewed in FIG. 9.

Finally, FIGS. 9 through 11 illustrate a presently preferred embodiment of the center male section 24 of the invention, which is the male portion of the center coupling member 14. A set of male plug tines 90 are electrically coupled to a pair of terminals 92 within a chamber 94 of the center male section 24. The chamber 94 is defined by a molded member 81. The molded member 81 extends axially toward the load bearing member 16 and defines a flange bearing member 83 which supports a saddle member 85. The flange bearing member 83 and the saddle member 85 are preferably bolted together to support a flange 87, as shown in FIG. 11.

Within the chamber 94, individual insulated electrical conductors 96 are mounted to the terminals, and pass out of the chamber, where they are enclosed within an outer insulating layer 98. Just as with the center female section, the cable 26 is embedded within an inner body 100 which is secured between upper and lower body members 17 and 19, with an open weave fabric therebetween. This functions as the load bearing member as previously described.

The male plugs 90 are embedded within an insulating block 102, which abuts the O-ring seal 84 when the electrical connection is made up. The block 102 also defines a a tool slot 91, similar to the tool slot 86 previously described. The block 102 is sealed against the molded body 81 by a gasket 104, and the molded body 81 seals against the cable 26 with an O-ring seal 106.

The present invention, herein described in detail, provides an inexpensive, yet robust and water resistant connection for an electrical extension cord. The mechanical coupling members are strong and robust, and provided with load bearing members at either end, so that a power tool can be lifted using a power cable, while the electrical connection is still made up.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. An electrical connector comprising:

a. a first load bearing member;

b. a female center section mounted to the first load bearing member;

c. a male center section adapted to electrically couple to the female center section;

d. a second load bearing member mounted to the male center section;

e. a mount around the female and male center sections for releasably coupling the female center section to the male center section; and f. a connector supplying cable coupled to the first load bearing member, and wherein the first load bearing member comprises:

i. a first inner body around the connector supplying cable;

ii. a first outer body surrounding the first inner body; and iii. a first open-weave fabric between the first inner body and the first outer body.

2. The connector of claim 1, wherein the mount comprises a bayonet mount.

3. The connector of claim 2, wherein the bayonet mount includes a cylindrical body axially slidable over the female center section.

4. The connector of claim 1, further comprising a seal member between the male and female center sections, providing a water resistant seal therebetween.

5. The connector of claim 1, wherein the outer body is formed of upper and lower halves.

6. The connector of claim 1, wherein the inner body has an outer surface defining an hour-glass function having a pinched in waist, and wherein the outer body has an inner surface parallel to the outer surface of the inner body.

7. The connector of claim 1, wherein the inner body extends into the female center section.

8. The connector of claim 1 further comprising a tool supplying cable coupled to the second load bearing member.

9. The connector of claim 8, wherein the second load bearing member comprises:

a. a second inner body around the tool supplying cable;

b. a second outer body surrounding the second inner body; and c. a second open-weave fabric between the second inner body and the second outer body.

10. An electrical connector comprising:

a. a first load bearing member;

b. a female center section mounted to the first load bearing member;

c. a male center section adapted to electrically couple to the female center section;

d. a second load bearing member mounted to the male center section;

e. a mount around the female and male center sections for releasably coupling the female center section to the male center section;

f. a tool supplying cable coupled to the second load bearing member; and wherein the second load bearing member comprises:

i. a second inner body around the tool supplying cable;

ii. a second outer body surrounding the second inner body; and iii. a second open-weave fabric between the second inner body and the second outer body.

11. An electrical connector comprising:

a. a first load bearing member;

b. a female center section extending around the first load bearing member, wherein the female center section defines a first curved inner surface, and wherein the first load bearing member defines a first curved outer surface conforming to the first inner surface;

c. a male center section adapted to electrically couple to the female center section;

d. a second load bearing member extending into the male center section;

e. a mount around the female and male center sections for releasably coupling the female center section to the male center section;

f. a connector supplying cable within the female center section; and g. a tool supplying cable within the male center section.

12. The connector of claim 11, further comprising a seal member between the male and female center sections, providing a water resistant seal therebetween.

13. The connector of claim 11, wherein the male center section defines a second curved inner surface, and wherein the second load bearing member defines a second curved outer surface conforming to the second inner surface.

14. The connector of claim 13, further comprising a first open weave outer lining between the first inner surface and first outer surface and further comprising a second open weave outer lining between the second inner surface and the second outer surface.

15. The connector of claim 14, wherein the first open weave outer lining extends onto the connector supplying cable, and wherein the second open weave outer lining extends onto the tool supplying cable.

* * * * *